US007268291B2

(12) United States Patent
Urbanski

(10) Patent No.: US 7,268,291 B2
(45) Date of Patent: Sep. 11, 2007

(54) STRINGED INSTRUMENT

(75) Inventor: Claudio Mario Urbanski, Conde 2044 4th Floor Ap. "H", Buenos Aires (AR)

(73) Assignees: Claudio Mario Urbanski, Buenos Aires (AR); Juan Hayd, Boulogne, Province of Buenos Aires (AR)

( * ) Notice: Subject to any disclaimer, the term of this patent is extended or adjusted under 35 U.S.C. 154(b) by 172 days.

(21) Appl. No.: 11/181,673

(22) Filed: Jul. 15, 2005

(65) Prior Publication Data

US 2006/0219093 A1 Oct. 5, 2006

(30) Foreign Application Priority Data

Apr. 4, 2005 (AR) ..... P050101313

(51) Int. Cl.

| | |
|---|---|
| ***G10H 3/00*** | (2006.01) |
| ***G10H 3/18*** | (2006.01) |
| ***G10H 3/14*** | (2006.01) |
| ***G10D 3/04*** | (2006.01) |
| ***G10D 1/08*** | (2006.01) |
| ***G10D 3/00*** | (2006.01) |

(52) U.S. Cl. ..... 84/731; 84/723; 84/734; 84/298; 84/267; 84/293

(58) Field of Classification Search ..... 84/723, 84/730, 731, 734, 267, 293, 298
See application file for complete search history.

(56) References Cited

U.S. PATENT DOCUMENTS

| | | | | |
|---|---|---|---|---|
| 4,955,274 | A * | 9/1990 | Stephens | 84/275 |
| 5,078,041 | A | 1/1992 | Schmued | |
| 5,322,969 | A | 6/1994 | Aaroe et al. | |
| 5,410,101 | A | 4/1995 | Sakurai | |
| 5,463,185 | A | 10/1995 | Fishman | |
| 5,817,966 | A * | 10/1998 | Fishman | 84/731 |
| 5,945,622 | A * | 8/1999 | Yamada | 84/731 |
| 6,023,019 | A | 2/2000 | Baggs | |
| 6,075,198 | A | 6/2000 | Grant et al. | |
| 6,274,801 | B1 | 8/2001 | Wardley | |
| 6,515,214 | B2 | 2/2003 | Takabayashi | |
| 6,822,156 | B1 | 11/2004 | Wai et al. | |
| 2003/0094094 | A1 * | 5/2003 | Nakaya | 84/736 |

* cited by examiner

*Primary Examiner*—Lincoln Donovan
*Assistant Examiner*—Andrew Millikin
(74) *Attorney, Agent, or Firm*—Egbert Law Offices

(57) ABSTRACT

A string instrument, such as a guitar, includes a sound box with saddle, a neck with tuning pegs and strings extended under tension between the saddle and the tuning pegs, providing a bridge of least two legs under which there are at least two separate piezoelectric transducers that are connected to an electrical circuit for the amplified reproduction of the sound of the instrument.

14 Claims, 3 Drawing Sheets

STRINGED INSTRUMENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a string instrument comprising electrical transduction means for the amplified reproduction of the sound produced by the instrument, this being an instrument such as a guitar, a violin, or the like, where the vibrations of the strings are separated into tones and transmitted to the piezoelectric transducers and then to a circuit for its acoustic reproduction.

BACKGROUND OF THE INVENTION

Using piezoelectric transducers in string instruments is well known in the art. For example, U.S. Pat. No. 5,410,101 is referred to a piezoelectric assembly clamped between a string holder and a bridge, provided with a dual layer arrangement of piezoelectric elements kept in contact with corresponding positive electrodes. The piezoelectric elements closer to the string holder detect string vibrations and the piezoelectric elements closer to the bridge detects body vibrations of the string instrument so that electric signals from piezoelectric elements of different groups can be tactfully blended together for rich and voluminous generation of musical tones over a wide tone range.

U.S. Pat. No. 6,822,156 of Lazarus et al. is referred to an acoustic guitar having two components that provide the signal that is representative of the guitar sound, a primary pickup device and a secondary pickup device. The primary device is the piezoelectric pickup that is situated between the strings beneath the saddle of a stringed instrument. The primary device is designed to detect the bulk of the sound as well as the tonal nuances. The secondary device as used in one embodiment of this invention makes use of the physically induced charge modulation properties along both the longitudinal and transverse axis of the interconnecting coax cable that runs from the primary pickup to the impedance changing preamplifier. An optional pair of pickups may be disposed outside the strings. Also, a compressible gasket may be placed between the pickup and saddle and the pickup and the bridge to prevent air gaps thereinbetween.

U.S. Pat. No. 6,515,214 of Takabayashi describes a pickup unit used for converting vibrations of strings to electric signals for producing electric tones at good loudness, and the pickup unit including a bridge assembly stationary to a body of the stringed instrument, vibration-responsive piezoelectric elements secured at the end portions thereof to the bridge assembly and vibration mediators held in contact with the strings and exerting force on the other end portions of the piezoelectric elements; since the vibration mediators have the freedom to move in the direction of the bending in the bridge assembly, the electric signals exactly represent the vibrations of the strings.

U.S. Pat. No. 6,274,801 of Wardley claims an instrument pickup assembly comprising, a piezoelectric transducer configured for association with a belly of a stringed instrument, a transmittable conduit associated with said piezoelectric transducer at a first end thereof, and means for securely positioning said piezoelectric transducer onto said belly of said stringed instrument.

U.S. Pat. No. 6,075,198 is referred to a rigid, solid bodied stringed instrument having an electrical pickup embedded in at least one predetermined position within the stringed instruments solid body to pick up the actual wood tones and resonance of the rigid solid body. The electrical pickup is comprised of a piezoelectric transducer embedded between a planar brass surface and a planar ceramic surface. In the preferred embodiment, the pickup transducer is circular in shape and embedded within the stringed instrument's solid body adjacent the strings which span the body. The embedded piezoelectric transducer requires a fraction of the area required by traditional electric coil pickups. In an alternate preferred embodiment, the pickup transducer is embedded within transducer housing. The housing is then embedded within the solid body of a stringed instrument adjacent the strings. By including the piezoelectric transducer within its own housing the pickup can be sold separately in the aftermarket and incorporated in solid body stringed instruments.

U.S. Pat. No. 6,023,019 refers to a stringed instrument, such as a guitar including a saddle for holding the strings and a pickup assembly for converting vibrations of the strings into electrical signals, the saddle has a curved bottom surface for contacting the pickup assembly. The pickup assembly is formed in flexible layers, including a first layer of insulation, a second layer of piezoelectric film with a ground lead on top, a third layer having contacts formed thereon in positions corresponding to the strings to create active areas in the film underneath the strings, the third layer having lead lines disposed at the bottom thereof, and additional lead lines at the bottom of a fourth flexible layer. Electrodes communicate one end of the lead lines with the contacts via through-holes in the intervening layers. The other ends of the lead lines fasten to pins which connect to an amplifier circuit.

U.S. Pat. No. 5,817,966 of Fishman refers to a transducer for a stringed musical instrument incorporating an electrically conductive ground plane, along with a piezoelectric transducer and a conductive strip. The piezoelectric transducer is comprised of a polyvinylidene fluoride co-polymer. The ground plane, piezoelectric transducers and conductive strip are secured in an elongated unitary structure with the ground plane and conductive strip disposed on opposite sides of the transducers. A conductive shield is disposed about the unitary structure and electrical leads connect to the ground plane and conductive strip, respectively. The transducer may also include two piezoelectric transducers and conductive strips to provide two different outputs from the transducer. The two piezoelectric transducers may have different frequency response characteristics or may be connected to different signal processing circuits to allow for distinct modulations and mixing of outputs.

U.S. Pat. No. 5,463,185 of Fishman claims a transducer for a stringed musical instrument incorporating an electrically conductive ground plane, along with a piezoelectric transducer and a conductive strip. The piezoelectric transducer is comprised of a polyvinylidene fluoride co-polymer. The ground plane, piezoelectric transducers and conductive strip are secured in an elongated unitary structure with the ground plane and conductive strip disposed on opposite sides of the transducers. A conductive shield is disposed about the unitary structure and electrical leads connect to the ground plane and conductive strip, respectively.

U.S. Pat. No. 5,322,969 claims a piezoelectric transducer saddle with a thin, generally rectangular member that is designed to fit into the bridge slot of a musical instrument such as a guitar. The piezoelectric element is oriented vertically in the saddle and constitutes a structural member of the saddle. In a first embodiment of the saddle, a piezoelectric element forms the saddle itself. Electrical contacts are engaged to the sides of the piezoelectric element to produce electrical output. A preferred embodiment of the saddle is a laminated structure wherein the laminated layers are disposed vertically, and a vertical layer composed of a piezoelectric material is generally centrally disposed within the laminated structure. A metallic electrical contact is engaged on each side of the piezoelectric material to receive electrical signals generated by the piezoelectric material. In one embodiment, one of the electrical contacts is formed as a metallic layer which rises to the upper surface of the saddle to make contact with the strings of the musical instrument, in order to provide a ground for the metallic musical strings of the instrument. Further embodiments of the present invention utilize multiple piezoelectric elements and shaped piezoelectric elements to produce enhanced performance.

U.S. Pat. No. 5,078,041 refers to a suspension bridge pickup mechanism for stringed musical instruments. Vibrations from the strings are transferred to a suspended bridge which is in contact at spaced points with resonator plates of a plurality of bimorphic piezoelectric elements. The bridge has a high length to transverse thickness ratio resulting in a signal of wide frequency range and high amplitude. The tonal characteristics and the relative harmonic content of the signal can be altered by selecting or rejecting specific transducers which will contribute to the output signal utilizing a switching circuit. The transducers may be positioned under different portions of the bridge resulting in greater low frequency response In the median region of the bridge, maximal mid frequency response in the paramedian region, and maximal high frequency response near the ends of the bridge. Resonator plates of large area and small thickness are employed for maximal reproduction of low frequencies and resonator plates of small area and greater thickness are employed for maximal reproduction of high frequencies. The instrument strings cross and is supported by the bridge asymmetrically of its length.

There are many string instruments, such as guitars and violins that are equipped with electroacoustic devices for the controlled reproduction of sound so as to reach higher volumes. Among known systems is the incorporation of a microphone inside the sound box of the instrument, where the microphone picks up the sound already produced and sent out by the instrument and transforms it into a signal that is amplified by an amplifier for its controlled reproduction. This results in a significant increase in the reproduction volume of the sound because the volume is determined by the amplifying devices; however, the quality of the sound reproduced is not good and the sound differs from the true one produced by the acoustic instrument.

In order to improve reproduction trying to make it as similar to the original sound as possible, piezoelectric microphones are used, which are placed under the bridge of said instrument to pick up the vibrations of the strings and the sound generated inside the sound box directly. This has improved sound quality compared to a microphone placed inside said sound box, but the sound is still not genuine and this use is restricted to certain types of music, such as jazz, rock, etc., and it is not used in those cases where the "purity" of the sound is relevant itself, for example, in a classic guitar concert, a violin concert, etc. In other words, the sound that is reproduced and amplified is still not similar to that of an acoustic string instrument.

Even though the use of piezoelectric transducers has notably improved the quality of the amplified sound, the transducers used nowadays and their disposition do not take advantage of the differentiation, separation, and selection of the vibrations generated by the different strings to manage each of them, or at least part of them, separately. This is because instruments that use piezoelectric transducers in fact use a single transducer or transducer set placed on the bridge of the violin or in the saddle of the guitar. This single transducer receives all vibrations of the different strings and turns them into signals that are sent to a processing circuit for amplification and acoustic emission.

Whatever the tone of the vibrations might be, they are all picked up by the same transducer but it is well known that not all transducers are the same, so not all of them are equally adequate to pick up and reproduce different signals or vibrations. Some transducers are better at converting high-pitched sounds, while others are better at converting low-pitched sounds.

Consequently it is still a market need a new set or disposition of piezoelectric transducers for string instruments where the vibrations produced by the instrument are differentiated and better processed.

BRIEF SUMMARY OF THE INVENTION

Then one of the objects of the present invention is to provide a string instrument with a transduction disposition that may allow amplifying and reproducing the genuine sound of the instrument more easily.

Another object of the present invention is to provide a string instrument, such as a guitar of the type comprising a sound box with saddle, a neck with tuning pegs and the strings extended under tension between said saddle and said tuning pegs, providing a bridge of at least two legs under which there are at least two separate piezoelectric transducers that are connected to an electrical circuit for the amplified reproduction of the sound of the instrument.

Still another object of the present invention is to provide a string instrument with a high sound quality, such as a guitar, of the type comprising a sound box with a saddle and a neck with tuning pegs, where said instrument comprises a bridge next to said saddle and consisting in an upper surface on which the strings rest extending between the saddle and the tuning pegs and a pair of support legs against the sound box under the pressure of the strings, including at least two piezoelectric transducers where each of them is disposed between each support leg and the sound box, the transducers being connected to a reproduction electrical circuit, so each of the transducers separately picks up the different vibrations generated, for example, of low, medium, and high frequency, thereby taking full advantage of the tones and their harmonics, also obtaining a better dynamic range of sound.

Still another object of the present invention is to provide a guitar, of the type comprising a sound box with a saddle and a neck with tuning pegs, where said guitar comprises a bridge and a saddle and wherein said bridge is split in two parts, the bridge itself and the saddle. This distance created depending on the type of instrument, the type of cords used and the type of music that is intended to play with said instrument allows an adjustment in the characteristics of the sound, namely: brilliant, dark, soft, wood, metal, crystal, boldly, etc.

Summing up, the present invention is referred to a stringed instrument, comprising a sound box having a neck with tuning pegs attached thereto, being attached to and extended between said tuning pegs and a saddle of the sound box a plurality of strings; wherein said strings rest on the top surface of a bridge, having said bridge a pair of support legs kept against the sound box under the pressure of the strings, including at least two piezoelectric transducers where each of them is disposed between each support leg and the sound box, being said transducers connected to an electrical reproduction circuit.

BRIEF DESCRIPTION OF THE SEVERAL VIEWS OF THE DRAWINGS

The foregoing and other objects of the present invention will be appreciated more fully from the following description, with reference to the accompanying drawings wherein.

DETAILED DESCRIPTION OF THE INVENTION

Figure 1:
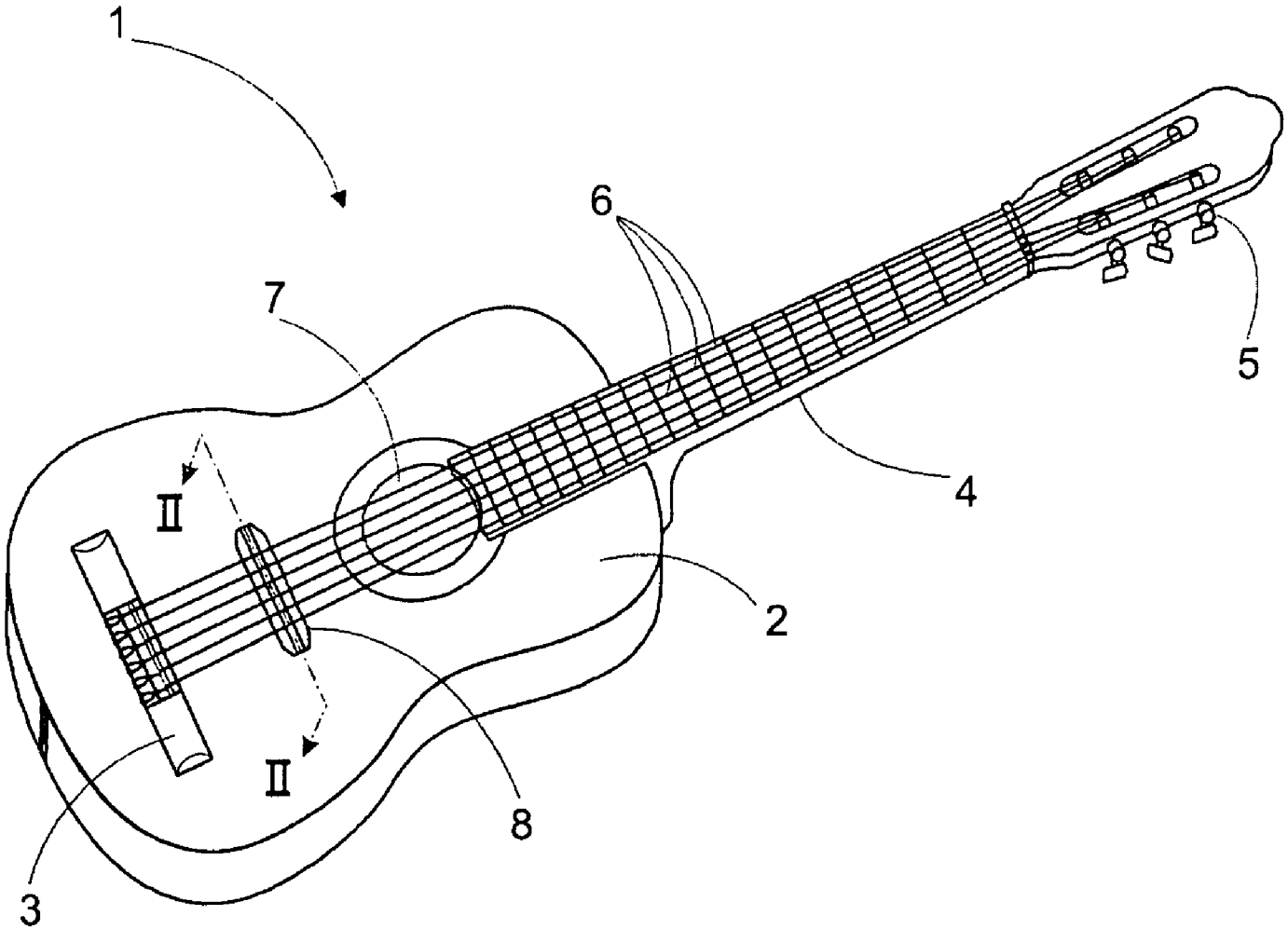
FIG. 1 is a top perspective view of the string instrument according to a preferred embodiment of the present invention.

In reference to the accompanying Figures, and more particularly to FIG. 1, the string instrument 1 object of the present invention comprises, as usual, a sound box 2 having a neck 4 with tuning pegs 5 attached thereto, being extended between said tuning pegs 5 and a saddle 3 of the sound box a plurality of strings 6 whose number will depend on the type of instrument, that is to say, a guitar, a violin, etc. The strings 6 will be tense enough as it is well known in the art, and the sound box may be equipped (FIG. 1) or not (FIG. 3) with an open sound hole 7 also depending on the type of instrument, for example, electro acoustic guitar, electric guitar, etc., as well as the intended use of the instrument, for example, studio recording, live performance, etc. The instrument is preferably made of wood and the box 2 may be a sound box.

Figure 3:
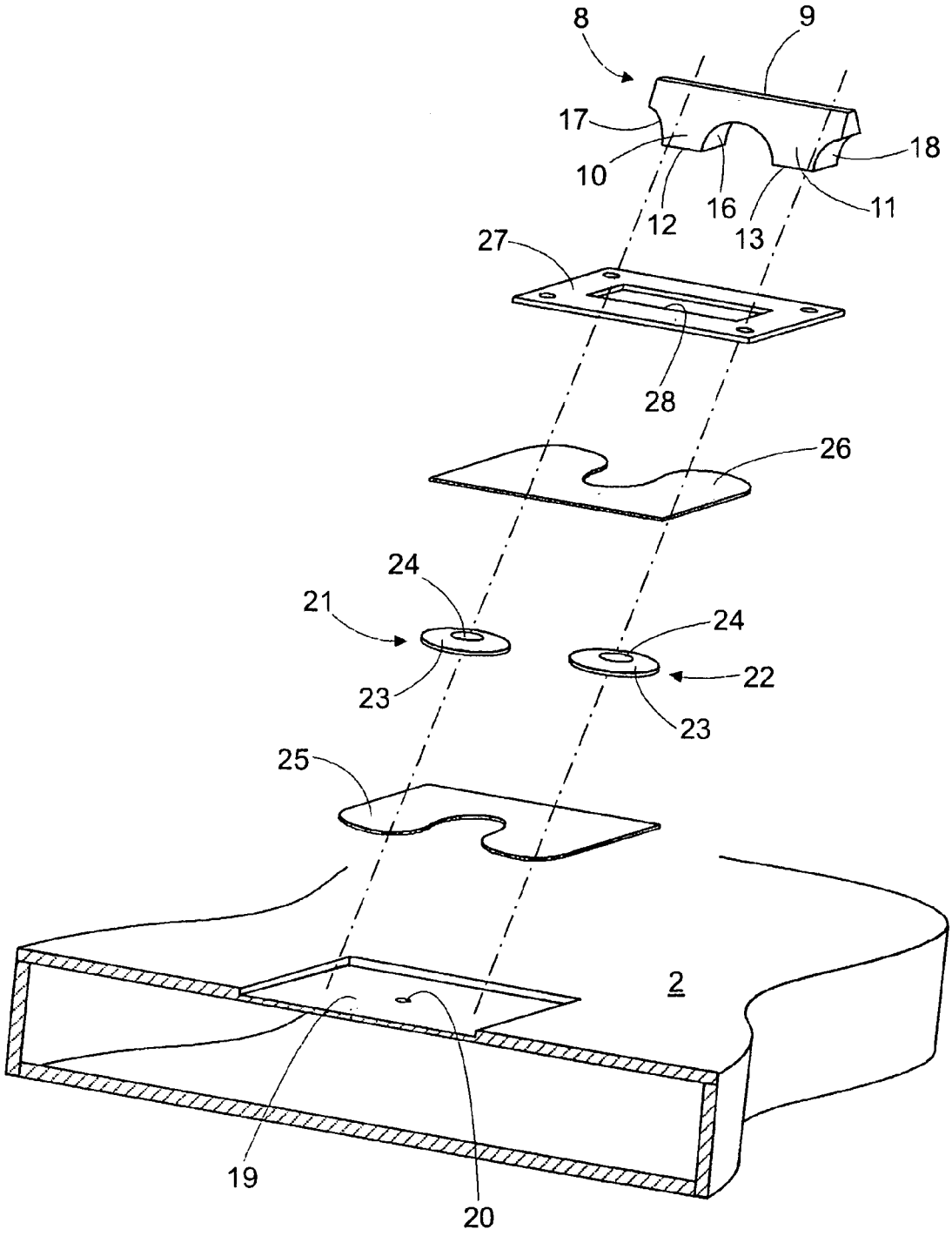
FIG. 3 is perspective and partially exploded 3 an sectional view of the instrument of FIGS. 1 and 2.

According to the present invention, the instrument 1 will be provided with a bridge 8 that in a preferred embodiment is close to said saddle 3 and in another preferred embodiment is spaced apart from said bridge. On the upper edge of said bridge strings 6 rest extended between the saddle to which they are attached and the tuning pegs that are used to adjust their tension. The bridge 8 comprises a piece preferably made of wood whose cross section is thicker in its base than in its top, as can be seen in FIG. 3. The bridge has a top surface or ridge 9 on which the strings 6 rest and at least two support legs 10 and 11 which define together a plane that rests, without leaving any free space, against the piezoelectric transducers 14 and 15. As will be described below, the bridge 8 may be kept against the sound box under the pressure of the strings 6 or there could be other additional fixing means. There will be at least two piezoelectric transducers, and each of them will be placed between each support leg 10, 11 and the box 2.

Between said legs 10, 11 an arch 16 is formed that is combined with arches 17 and 18 formed at the end of the bridge 8. The design and characteristics of said arches can be modified to adjust the timbre parameters of the instrument. The design and provision of said arches will depend on the type of instrument in question, that is to say, if it is a guitar, a violin, a violincello, etc. In fact, in some case this bridge may be avoided, depending on the type of music that is intended to be played. The thickness of the bridge 8 is also variable, preferably having a wider base than its top, being such design also a timbre-adjustment parameter. The bridge is made of wood (even when it may be made of any other appropriate material) and will preferably be free of inserts, supplements, cables, etc. This provides to the invention with two key and inventive characteristics compared to other instruments: a pure and authentic sound and the possibility of customizing the instrument, since the bridge may be replaced without having to change the piezoelectric transducers, something that cannot be done with similar instruments, where the piezoelectric transducer is incorporated inside the bridge.

The position relationship between the saddle and the bridge may vary depending on the instrument and other design characteristics, but the saddle may be placed in the lower end of the neck or at the end of the sound box, at a proportional and specific distance from the bridge and located in such a way that the strings form a marked angle pressing the bridge against the sound box or the neck. This pressure may also be varied with the height of the design of the bridge 8. As can be seen, the new bridge provides for the adjustment of several parameters to customize the instrument according to the invention. These adjustment parameters may also be varied by modifying the distance between the purposed bridge and the saddle of the instrument. In fact the distance between the saddle 3 and the bridge 8 is one of the key factors of the present invention. The manufacturer may vary this distance for adding customized characteristics to the instrument.

Figure 2:
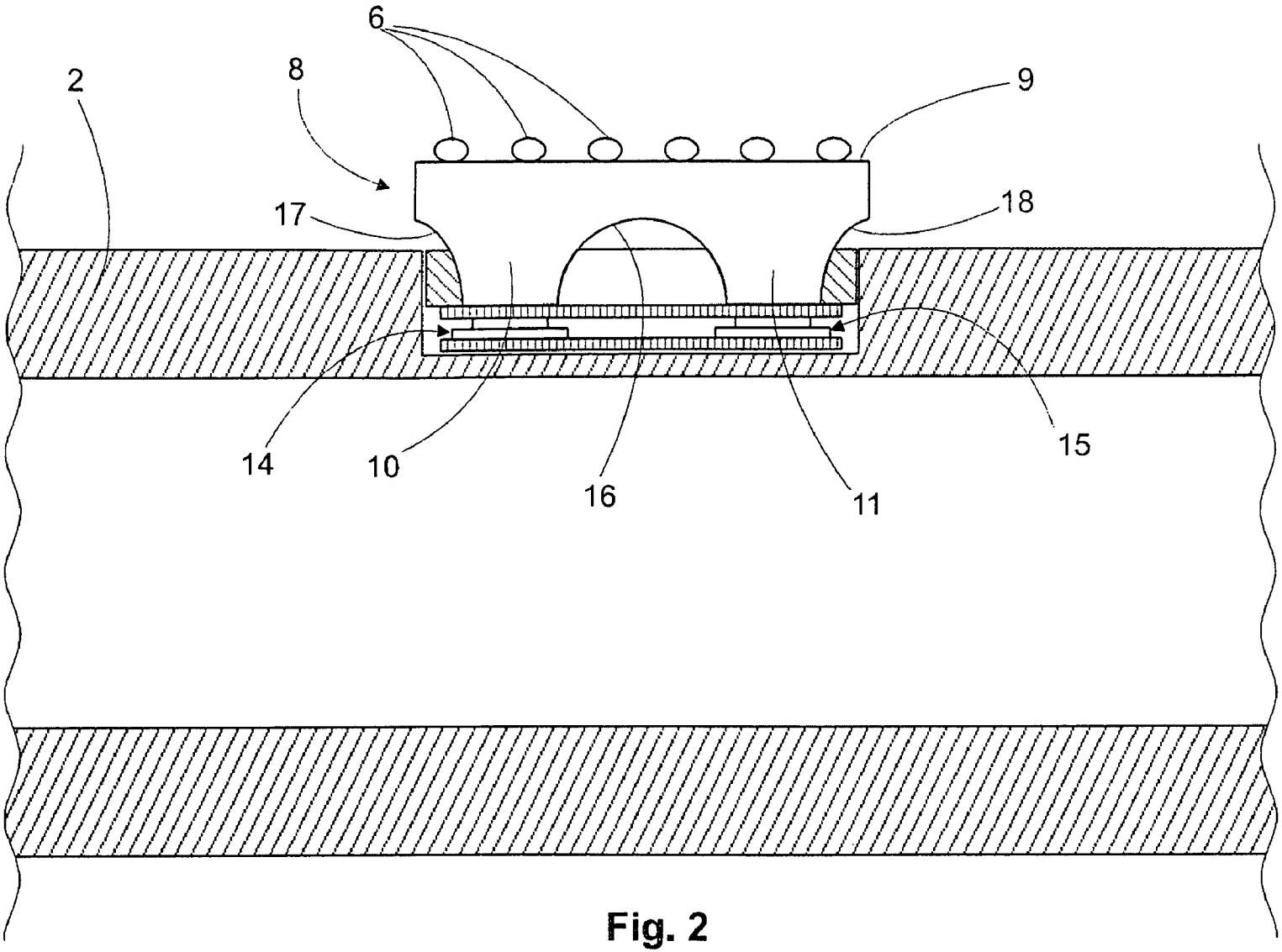
FIG. 2 is a sectional view along II-II of FIG. 1.

The piezoelectric set according to the present invention is illustrated in FIGS. 2 and 3. Box 2 has a rabbet 19 in whose bottom there is a hole 20 for the passage of the cables that connect the piezoelectric transducers with a control circuit, not illustrated because it may be of any known type. Under each leg 10, 11 there is a piezoelectric transducer 21, 22, preferably of the "diaphragm" type, discoidal, consisting in a metal disc 23 for ground contact and a ceramic disc 25 for positive contact. Above and below the piezoelectric transducers two contact plates 25, 26 made of a material called "Spanish paper" or any other conductive plate or film are disposed. Each of said contact plates 25, 26 will be in electrical contact with said metal disc 23 and ceramic disk 24, respectively, and each of the plates 25, 26 will in turn be connected to a conductive "positive" and "ground" contact cable that will feed the signals from the piezoelectric transducers to an electrical circuit that may be of any known type, for the amplification and acoustic reproduction of the instrument. This circuit is neither described nor illustrated as does not form part of the present invention.

According to one of the characteristics of the present invention, said piezoelectric transducers 21, 22 are independent from each other and may be of different types, in whose case each type is selected in order to best reproduce the tones of the associated strings. Preferably, said transducers are disposed between the corresponding support leg and the box in a free way, being attached only by the pressure of the bridge leg against the box. All this allows to exchange the piezoelectric transducers at the user's will without having to change the whole set and thus obtain the best combination of transducers.

However, according to a preferred embodiment of the present invention, the piezoelectric set may be retained inside the rabbet 19 by means of a removable lid 27 which in turn has a window 28. Depending on the type of instrument there may be only one window 28 (such as for example in a guitar, a bass, a charango) or there may be two windows (such as in a violin, a cello, viola da gamba) for the bridge support legs 10, 11 to go through, so that each leg rests against its corresponding piezoelectric transducer without interference.

As it has been explained above, the concepts of the present invention may be applied to many string instruments, such as guitars, violas, violins, etc.; the sound box 2 does not necessarily have to be hollow. Instead, the sound box 2 may be solid or totally or partially hollow, being said alternatives variants of the color of the sound produced by the instrument. It is worth mentioning that the addition of the sound box 2 is not a determining factor of the quality of the sound produced by the instrument 1, but only helps to achieve a variety of sound qualities and colors.

Even when it has been described that the piezoelectric elements are integral to the instrument's body there are some cases, for example in a banjo, where the amplifying means defined by the piezoelectric pieces and the bridge on a wood board, may be located on the body of the instrument for picking up the sound to be amplified by external traditional amplifying means.

From what has already been mentioned in the present description, we can conclude that the string instrument object of the present invention achieves high quality tuning and sonority similar to those of acoustic instruments of excellent quality.

I claim:

1. A stringed instrument comprising:

a sound box having a neck extending therefrom, said neck having tuning pegs attached thereto, said sound box having a saddle affixed thereto, said sound box having a bridge affixed thereto and positioned between said saddle and said tuning pegs, said sound box having a rabbet formed in a surface thereof;

a plurality of strings attached to and extending between said turning pegs and said saddle, said plurality of strings resting on said bridge, said bridge having a pair of support legs residing against said surface of said sound box under a pressure exerted thereto by said plurality of strings;

at least two piezoelectric transducers disposed respectively between said pair of legs and said sound box, the transducers being connected to an electrical reproduction circuit, the transducers being disposed in said rabbet of said sound box between a pair of contact plates; and a lid removably affixed to said surface of said sound box, said lid retaining the transducers and said pair of contact plates in said rabbet, said lid having a window formed therein, said pair of support legs extending through said window so as to rest against a respective transducer.

2. The stringed instrument of claim 1, the transducers being independent of each other.

3. The stringed instrument of claim 2, the transducers being different from each other, each of the transducers corresponding to a tone of a respective string of said plurality of strings.

4. The stringed instrument of claim 1, each of the transducers having a discoidal shape.

5. The stringed instrument of claim 1, the transducers being freely disposed between the support leg and said sound box, the transducers being retained in position only by the pressure of the support leg against said sound box.

6. A stringed instrument comprising:

a sound box having a neck extending therefrom, said neck having tuning pegs attached thereto, said sound box having a saddle affixed thereto, said sound box having a bridge affixed thereto and positioned between said saddle and said tuning pegs, said sound box having a rabbet formed in a surface thereof;

a plurality of strings attached to and extending between said turning pegs and said saddle, said plurality of strings resting on said bridge, said bridge having a pair of support legs residing against said surface of said sound box under a pressure exerted thereto by said plurality of strings;

at least two piezoelectric transducers disposed respectively between said pair of legs and said sound box, the transducers being connected to an electrical reproduction circuit, said at least two piezoelectric transducers comprising a metal disc suitable for ground contact and a ceramic disc suitable for positive contact.

7. The stringed instrument of claim 6, the transducers being disposed in said rabbet of said sound box between a pair of contact plates, said pair of contact plates respectively contacting said metal disc and said ceramic disc.

8. A stringed instrument comprising:

a sound box having a neck extending therefrom, said neck having tuning pegs attached thereto, said sound box having a saddle affixed thereto, said sound box having a bridge affixed thereto and positioned between said saddle and said tuning pegs, said sound box having a rabbet formed in a surface thereof;

a plurality of strings attached to and extending between said turning pegs and said saddle, said plurality of strings resting on said bridge, said bridge having a pair of support legs residing against said surface of said sound box under a pressure exerted thereto by said plurality of strings;

at least two piezoelectric transducer disposed respectively between said pair of legs and said sound box, the transducers being connected to an electrical reproduction circuit, said saddle located in a lower end of said neck, said bridge positioned in spaced relation to said saddle.

9. The stringed instrument of claim 8, said bridge being of a wooden material.

10. The stringed instrument of claim 8, said bridge having a cross-sectional thickness that is thicker at a base thereof than at a top thereof.

11. The stringed instrument of claim 8, said pair of support legs having an arch extending therebetween.

12. The stringed instrument of claim 11, each of said support legs having an arch-shaped outer side.

13. The stringed instrument of claim 8, the transducers being disposed in said rabbet of said sound box between a pair of contact plates, each of said pair of contact plates being a conductive plate.

14. The stringed instrument of claim 8, the transducers being disposed in said rabbet of said sound box between a pair of contact plates, each of said pair of contact plates being a conductive film.

* * * * *